United States Patent [19]

Hernqvist

[11] 4,288,719

[45] Sep. 8, 1981

[54] CRT WITH MEANS FOR SUPPRESSING ARCING THEREIN

[75] Inventor: Karl G. Hernqvist, Princeton, N.J.

[73] Assignee: RCA Corporation, New York, N.Y.

[21] Appl. No.: 18,907

[22] Filed: Mar. 9, 1979

[51] Int. Cl.[3] ..... H01J 29/02; H01J 29/46; H01J 29/56

[52] U.S. Cl. ..... 313/457; 313/479; 313/417

[58] Field of Search ..... 313/457, 417

[56] References Cited

U.S. PATENT DOCUMENTS

| | | | |
|---|---|---|---|
| 2,476,060 | 7/1949 | Moss | 313/457 |
| 3,355,617 | 11/1967 | Schwartz et al. | 313/450 |
| 3,558,954 | 1/1971 | Lilley | 313/313 |
| 3,771,003 | 11/1973 | Kerr et al. | 313/313 |
| 3,932,786 | 1/1976 | Campbell | 313/414 |
| 4,032,811 | 6/1977 | Schwartz et al. | 313/417 |
| 4,095,138 | 6/1978 | Schwartz | 313/16 |
| 4,143,298 | 3/1979 | Bing et al. | 313/450 X |

*Primary Examiner*—Robert Segal

*Attorney, Agent, or Firm*—E. M. Whitacre; G. H. Bruestle; L. Greenspan

[57] ABSTRACT

A CRT comprising an evacuated envelope having an electrically-insulating neck and a beaded electron-gun mount assembly in the neck. The beads of the assembly are closely spaced from the inner surface of the neck. At least a portion of the surfaces of the beads opposite the neck is electrically conducting.

9 Claims, 7 Drawing Figures

CRT WITH MEANS FOR SUPPRESSING ARCING THEREIN

BACKGROUND OF THE INVENTION

This invention relates to a novel CRT (cathode-ray tube) having means for suppressing arcing therein; and particularly for suppressing flashovers in the neck of a CRT having a beaded mount assembly.

A color television picture tube is a CRT which comprises an evacuated glass envelope including a viewing window which carries a luminescent viewing screen, and a glass neck which houses an electron-gun mount assembly for producing one or more electron beams for selectively scanning the viewing screen. Each gun comprises a cathode and a plurality of electrodes supported as a unit in spaced tandem relation from at least two elongated, axially-oriented support rods, which are usually in the form of glass beads. The beads have extended surfaces closely spaced from and facing the inner surface of the glass neck. The beads usually extend from the region close to the stem, where the ambient electric fields are small, to the region of the electrode to which the highest operating potential is applied, where the ambient electric fields are high during the operation of the tube. The spaces between the beads and the neck surfaces are channels in which leakage currents may travel from the stem region up to the region of the highest-potential electrode. These leakage currents are associated with blue glow in the neck glass, with charging of the neck surface and with arcing or flashover in the neck. The driving field for these currents is the longitudinal component of the electric field in the channel.

Several expedients have been suggested for blocking or reducing these leakage currents. Coatings on the neck glass are partially effective to prevent arcing but are burned through when arcing does occur. A metal wire or ribbon in the channel (partially or completely around the mount assembly) is also partially effective to reduce arcing because it is often bypassed due to its limited longitudinal extent, because the limited space between the bead and the neck may result in shorting problems, and because there is frequently field emission from the metal structure.

SUMMARY OF THE INVENTION

The novel CRT comprises an evacuated envelope including a neck of glass or other insulating material. An electron-gun mount assembly including a plurality of electrodes mounted on at least two support rods or beads of glass or other electrically-insulating material, is housed in the neck with the beads closely spaced from the inside of the neck. Each bead has an electrically-conducting area, such as a metal coating, on the surface thereof facing the neck. The conducting areas may be electrically floating, which is preferred, or may be connected to an electrode of the mount assembly or to a fixed voltage. Also, the conducting areas are preferably tapered to be thinner towards their edges, particularly the edges towards the electrode carrying the highest potential.

Each conducting area has the effect of neutralizing the longitudinal electric field in its channel, thereby reducing the longitudinal current in the channel, at least to the point that arcing is suppressed substantially. Each conducting area, in any of its forms, requires only a minimum of space in which to exist. Tapering the thickness of the area to a thin smooth edge can reduce field emission from the conducting area to trivial values so that the area can extend to very close to the electrode carrying the highest operating potential, thereby providing even better capability for suppressing arcing.

DETAILED DESCRIPTION OF THE PREFERRED EMBODIMENT

Figure 3:
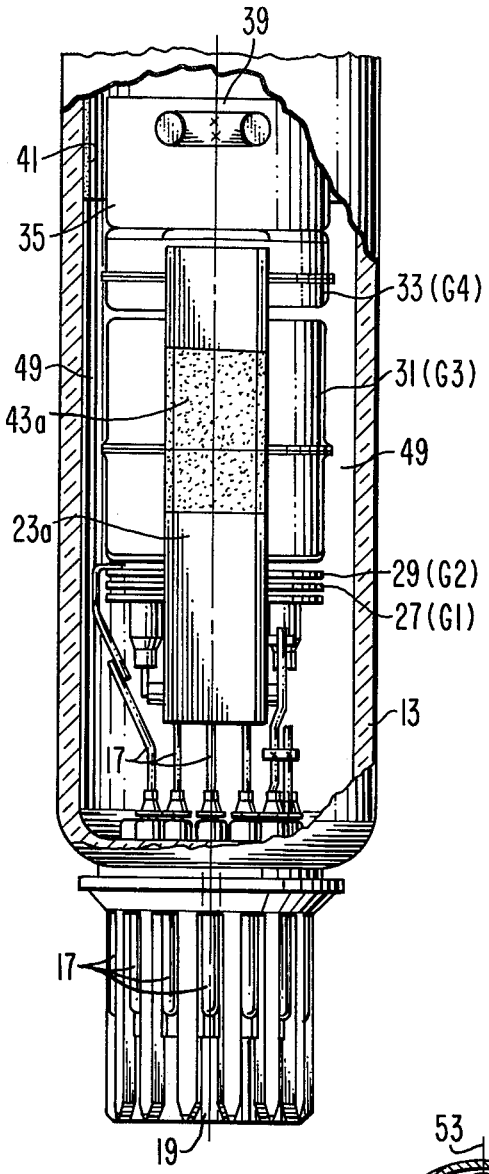
FIG. 3 is a broken-away, side, elevational view along section line 3—3 of the neck of the CRT shown in FIG. 1.
Figure 1:
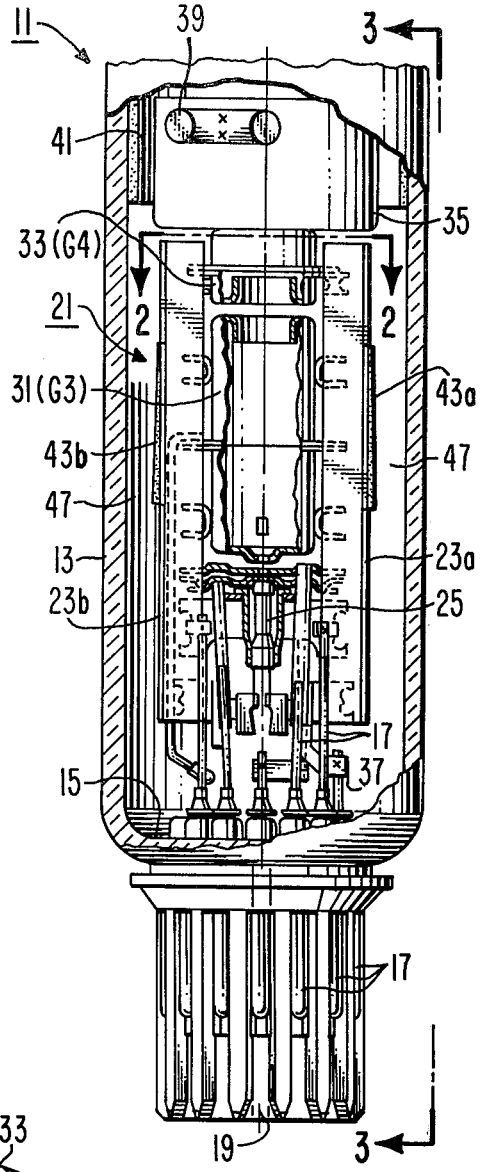
FIG. 1 is a broken-away, front, elevational view of the neck of a preferred CRT according to the invention.
Figure 2:
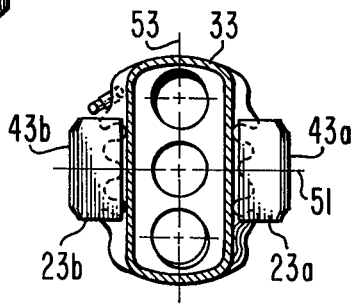
FIG. 2 is a sectional view along section line 2—2 through the neck of the CRT shown in FIG. 1.

FIGS. 1, 2 and 3 show structural details of the neck of a particular shadow-mask-type color television picture tube. The structure of this CRT, which is a rectangular 25 V size tube with 110° deflection, is conventional except for the electron-gun mount assembly. The structural details thereof are similar to those described in U.S. application Ser. No. 895,588 filed Apr. 12, 1978 by R. H. Hughes et al. The CRT includes an evacuated glass envelope 11 comprising a rectangular faceplate panel (not shown) sealed to a funnel having a neck 13 integrally attached thereto. A glass stem 15 having a plurality of leads or pins 17 therethrough is sealed to and closes the neck 13 at the end thereof. A base 19 is attached to the pins 17 outside the envelope 11. The panel (not shown) includes a viewing window which carries on its inner surface a luminescent viewing screen comprising phosphor lines extending in the direction of the minor axis thereof, which is the vertical direction under normal viewing conditions.

An in-line beaded bipotential electron-gun mount assembly 21, centrally mounted within the neck 13, is designed to generate and project three electron beams along coplanar convergent paths to the viewing screen. The mount assembly comprises two glass support rods or beads **23*a* and 23*b* from which the various electrodes are supported to form a coherent unit in a manner commonly used in the art. These electrodes include three substantially equally transversely spaced coplanar cathodes 25 (one for producing each beam), a control-grid electrode (also referred to as $G_1$) 27, a screen grid electrode (also referred to as $G_2$) 29, a first accelerating and focusing electrode (also referred to as $G_3$) 31, a second accelerating and focusing electrode (also referred to as $G_4$), 33, and a shield cup 35, longitudinally spaced in that order by the beads 23*a* and 23*b*. The various electrodes of the mount assembly 21 are electrically connected to the pins 17 either directly or through metal ribbons 37. The mount assembly 21 is held in a predetermined position in the neck 13 on the pins 17 and with snubbers 39 which press on and make contact with an electrically-conducting internal coating 41 on the inside surface of the neck 13. The internal coating 41** extends over the inside surface of the funnel and connects to the anode button (not shown).

Each of the beads 23*a* and 23*b* is about 10 mm (millimeters) wide by 25 mm long and carries an electrically-conducting area or patch 43*a* and 43*b* respectively on a portion of its surface facing and spaced from the inside surface 45 of the neck 13. In this example, each area 43*a* and 43*b* is a coating of chromium metal that was deposited in vacuum from evaporated metal vapor after the mount assembly was assembled. Each area 43*a* and 43*b* is substantially rectangular and about 15 mm long by about 10 mm wide, which is the full width of the bead. Each area is about 1000 Å thick except at the edges where it is tapered to a thickness of about 500 Å. Each area is floating electrically. Each area has a resistivity of about 50 ohms per square as measured with silver paste contacts applied along the upper and lower edges of the area and spaced about 12 mm apart.

The tube may be operated in its normal way by applying operating voltages to the pins 17 and to the internal coating 41 through the anode button; which, for example, are typically less than 100 volts on $G_1$, about 600 volts on $G_2$, about 5,000 volts on $G_3$ and about 30,000 volts on $G_4$. Because of the beaded structure described, the regions between the beads and the neck, which can be called the bead channels 47, behave differently than the regions between the neck and the other parts of the mount assembly, which can be called the gun channels 49. Arcing (flashover), when it occurs, occurs in the bead channels 47, when the tube is operating and the conducting areas 43*a* and 43*b* are absent. However, with the conducting areas present as shown in FIGS. 1, 2 and 3, arcing in these channels is substantially entirely suppressed.

Several different types of breakdown phenomena have been observed with mount assemblies of the type described above. From the point of view of the required preventive measures, these phenomena are conveniently classified as (a) breakdowns occurring directly from one metallic electrode to another (primarily between $G_3$ and $G_4$, and to a lesser extent between $G_2$ and $G_3$) and (b) breakdowns involving insulators (primarily the neck glass) as intermediaries.

A direct electrode-to-electrode breakdown is usually due to the presence of one or more of microprotrusions or dust on an electrode or due to the passage of particulate matter from one electrode to another. Sharp points or edges and weld splash on $G_3$ can cause cold (field) emission leading to breakdown events. The main preventive measure here is high-voltage processing, mainly spot knocking. Intense discharges during this electrical processing cause melting, vaporization or blunting or sharp points. The high voltage also seeks out dust and other particles, and these are disintegrated or transported to less stressed regions of the gun. Ordinary spot knocking may leave craters with sharp edges on polished surfaces, particularly in areas subjected to the fringe fields. RF spot knocking appears to sweep away crater material leaving a much smoother surface. To manufacture kinescopes without the spot knocking step would require meticulous processing and handling of parts, and also assembly of guns and even manufacturing under "clean-room" conditions. Such a procedure would be extremely costly. Therefore, not only does the spot knocking do a superb job in suppressing electrode-to-electrode breakdowns, but it is also cost effective.

A breakdown involving the neck glass (flashovers) requires charging of the inside surface of the neck glass and is usually preceded by easily-visible blue glow of the glass. This phenomenon can occur at the top and flange portions of $G_3$ where it is easily prevented by effective RF spot knocking. A more severe form of flashover involves cold (field) emission in the stem region of the gun where spot knocking is less effective. The usual series of events leading to a flashover is believed to proceed according to the following steps: (1) Due to the small but finite conductivity of the neck glass, the applied voltage to $G_4$ (about 30 kv) makes itself felt opposite the lower portion of the gun. (2) If points or protrusions are present in this region, field-emitted electrons from these points strike the neck glass. (3) Secondary electron emission from and electron charging of the neck glass occur leading to electron avalanches along the neck glass, primarily along the relatively isolated bead channel formed between the bead and the neck glass. These avalanches, which cause the blue glow of the glass due to electron bombardment, terminate opposite $G_4$. The avalanches can be quite stable carrying leakage currents of up to a few microamperes during the total life of the CRT. (4) The electrons flowing in the avalanches along the glass can cause desorption of the adsorbed gas atoms on the glass. This gas can be ionized by the electrons, and the ions, under the influence of electric fields that are present, can travel to the field emitter, causing more emission (ion feedback). Thus, a runaway condition can occur, leading to flashover (arcing). After the flashover has been extinguished, the gas is drawn out of the bead channel, the glass is discharged, and the whole process steps (1) to (4), may be repeated. However, after each flashover, the field emitters present may be more blunted and also the glass neck may be more outgassed; thus, the tube can arc itself to stability, as is frequently observed. Arcing-to-stability is, however, a time-consuming process since each charging-flashover cycle may last for periods of minutes up to tens of minutes.

In principle, any measure that impedes any of the events in the charging-flashover cycle may prevent arcing. The following are some of these preventive measures that can be taken. First, the use of a low conductivity glass, which requires the glass to be substantially ion-free, could minimize the magnitude of the electric fields present in the lower end of the gun. However, an ion-rich glass is required for various practical reasons in envelope construction, thereby making this approach impractical. Second, the absence of field-emission centers could prevent electron avalanches from building up. This requires the prevention of microprotrusions, which would require meticulous and laborious parts preparation and assembly. Rigorous spot knocking in the stem region cannot be expected to be practical due to poor field penetration, and also because sensitive parts (heater and seals) in this region may limit the processing. Sputter cleaning of this region as part of tube processing is considered to be impractical because the large amount of material removal necessary for emitter blunting could cause stem-leakage problems. Laser ignition to speed up the arcing-to-stability process may require a search for specific emission centers, a very time-consuming process which is not amenable to mass production. Third, obstacles in the path of the electron avalanches along the glass have been suggested. These obstacles (generally referred to as suppressors) have been found to be effective in suppressing the formation of avalanches. The suppressor may consist of a metal wire or ribbon tied to $G_3$ and traversing the channel between the bead and the neck glass. Other obstacles found effective are conducting coatings on the neck glass along this channel. Avalanches along the glass may by themselves be harmless. But, flashovers, especially when they occur frequently, may burn through such coating producing undesirable debris. A fourth preventive measure is more effective outgassing of the neck glass during tube processing, since flashovers are associated with gas desorption. This may require longer baking and cathode activation during the exhausting of the CRT. Both of these measures are considered to be too costly.

Figure 4:
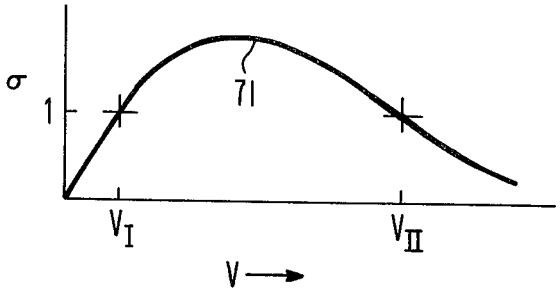
FIG. 4 is a curve showing some conditions for secondary emission from a glass surface.

The mechanics of establishing electron avalanches has been extensively discussed in the literature. Two electron-emission processes, namely field emission and secondary electron emission, are important. Field emission is a cold-emission process requiring very high fields ($\sim 10^7$ volts/cm) at the emitter. The electron emission current density j is given by $$j = 3.2 \times 10^{-6} \frac{E^2}{\phi} \exp\left[-6.8 \times 10^7 \phi^{3/2} E^{-1}\right] A/\text{cm}^2 \quad (1)$$

where E (volts/cm) is the electric field at the emitter, and $\Phi$ is the emitter work function. Frequently E is much larger than V/d where V is the emitter-to-collector voltage and d is the distance between electrodes. This field enhancement is due to microprotrusions at the emitter. However, for any given case, j increases with V and decreases with d. Secondary electron emission is encountered when any object (metal or insulator) is bombarded with a primary beam of electrons. The yield of secondary emission $\sigma$ is given by $$\sigma = \frac{\text{No. of secondary electrons}}{\text{No. of primary electrons}}$$

which is a function of the primary electron impact energy v. This relation between $\sigma$ and V is usually of the form shown in the curve 71 in FIG. 4. Of particular significance are the values of the impact energies $V_I$ and $V_{II}$ for which $\sigma=1$. Important also is the average initial energy $\overline{V}_o$ at which the secondary electrons come off the emitters. Typically for glass, $V_I=30$ volts, $V_{II}=2500$ volts, and $\overline{V}_o=5$ volts.

The case when the secondary emitter is an insulator (for instance, the neck glass) requires special consideration since equal numbers of electrons must arrive and leave the emitter. Except when $V=V_I$ or $V_{II}$, the insulator surface always charges up to some potential to satisfy this requirement.

Consider first the case when electrons are field emitted by a sharp point near the insulator surface and strike the surface with energy V such that $V_I<V<V_{II}$. Since $\sigma>1$, more electrons leave the surface than arrive and the glass charges positively. This increases V and thus the current (according to equation (1)). The charging continues until $V=V_{II}$. If V were to increase above $V_{II}$, the glass would charge more negative restoring the surface potential to $V_{II}$, which is a stable point.

A second case to be considered is when the emitted electrons return to the glass at another point on the glass. This requires a retarding field for the emitted electrons $E_r$ and an electric field parallel to the surface $E_z$. An approximate mechanical analog to this case is the throwing of a ball down an inclined plane. The impact energy Fi of the electron at the second point is $$V + \overline{V}_o\left[1 + 4\left(\frac{E_z}{E_r}\right)^2\right] \quad (2)$$

Assuming that V is slightly larger than $V_I$, then $\sigma>1$. When the surface charges positively at this point making $E_r$ larger. In accordance with equation (2), V then decreases returning the potential to $V_I$. Similarly, if V is less than $V_I$, an increase in V occurs again approaching $V_I$ which is a stable point. Applying the same reasoning, it can be shown that $V_{II}$ is unstable. Thus for stability $$V_I = \overline{V}_o\left[1 + 4\left(\frac{E_z}{E_r}\right)^2\right] \quad (3)$$

or $$\left|\frac{E_z}{E_r}\right| = \sqrt{\frac{V_I - \overline{V}_o}{2\,\overline{V}_o}} \quad (4)$$

Typically for glass $|E_z/E_r| \approx 1.58$.

In the mount assembly shown in FIGS. 1 to 3, the electrodes are supported by two elongated glass beads 23*a* and 23*b* along the main portions of the assembly. In an axial plane 51 (FIG. 2) cutting through the middle of the beads 23*a* and 23*b* and the bead channels, and referred to as the bead plane, the metal parts are separated from the neck glass by the glass beads. A relatively isolated bead channel 47 (FIG. 1) is formed between each glass bead 23*a* and 23*b* and the neck glass 13. In an axial plane 53 (FIG. 2) perpendicular to the bead plane and referred to as the gun plane, the metal parts of the gun are close to the neck glass 13. Experimental observations have shown that electron avalanches occur almost exclusively in the bead channels 47 and only along the neck glass 13.

Figure 5:
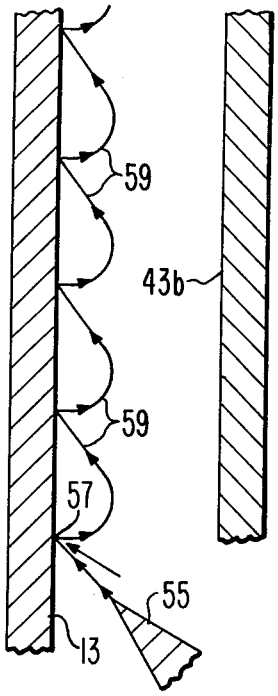
FIG. 5 is a schematic representation of an electron avalanche up the inner neck wall of a CRT.

A model for establishing an avalanche with reference to FIG. 5 is as follows: The primary electron emission is due to field emission from microprotrusions 55 in the lower end of the mount assembly. Primary electron impact 57 occurs on the neck glass 13 at the lower end of the bead 43*b* for example or along the side of the bead 43*b* in the $G_1$–$G_2$ area. Electron avalanches 59 proceed along the neck glass 13 in the bead channel 47 and terminate at or near G4. The primary impact and current are determined by equation (1). Each step in the electron avalanche process is governed by equation (4). The electric fields necessary as determined by equation (4) are a result of superposition of the original fields $E_{zo}$ and $E_{ro}$ and the fields $E_{\rho z}$ and $E_{\rho r}$ due to charging of the neck glass. Thus, $$|E_z| = E_{2o} + E_{\rho z} \quad (5)$$

and $$|E_r| = E_{ro} + E_{\rho r} \quad (6)$$

$E_{\rho z}$ and $E_{\rho r}$ are directly related to the charge density $\sigma$ at the neck glass surface by the relations $$|E_{\rho z}| = K\,E_{\rho r} \text{ and } |E_{\rho r}| = (\rho/2\epsilon_o) \quad (7)$$

where K = constant and $\epsilon_o$ = dielectric constant of vacuum. If the unperturbed fields $E_{zo}$ and $E_{ro}$ are known, equations (4), (5) and (6) allow the necessary charge density along the neck glass for maintenance of electron avalanches to be computed.

Figure 6:
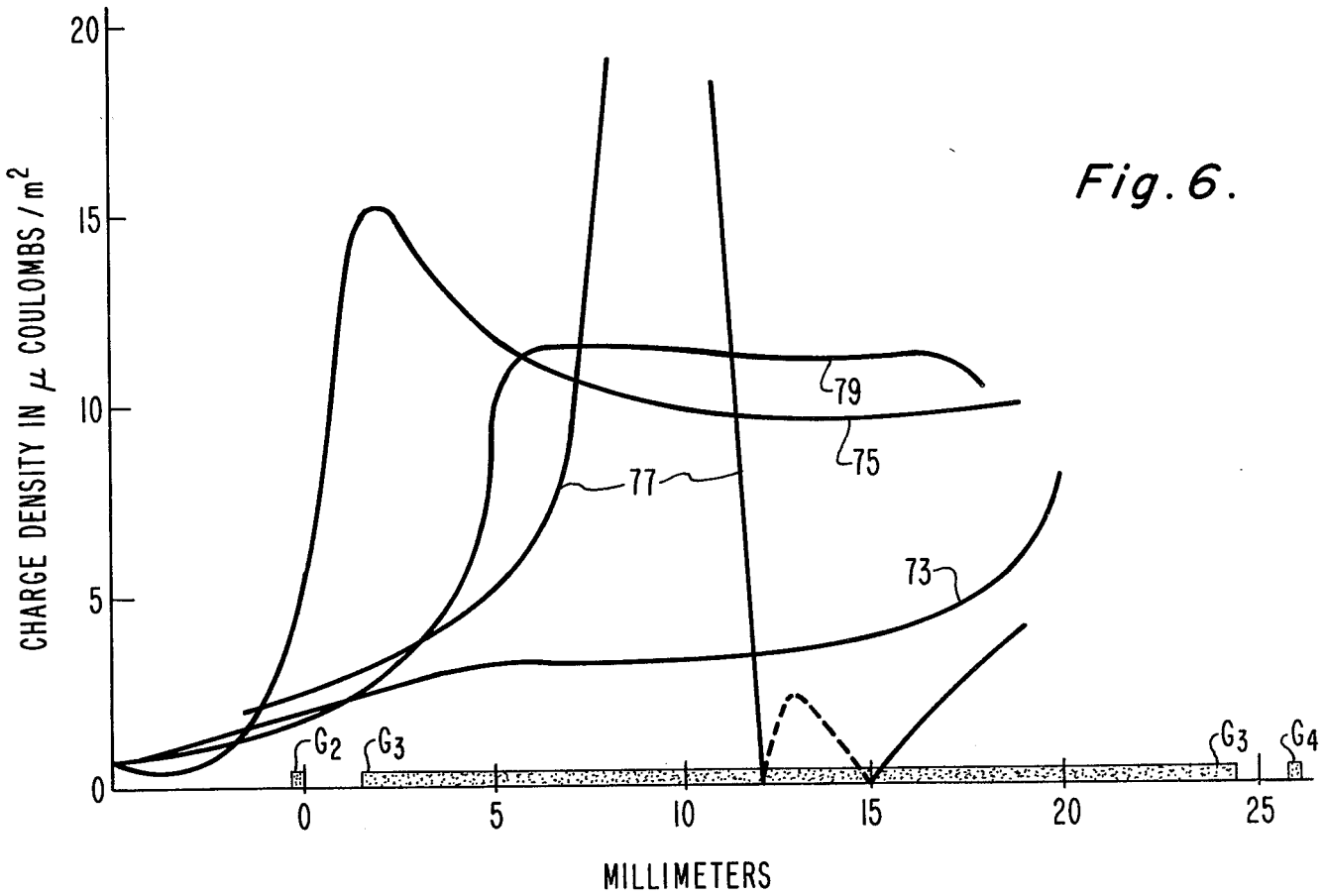
FIG. 6 is a family of curves showing the comparative likelihood for flashover under four different circumstances.

Computations of $E_{zo}$ and $E_{ro}$ have been done for the type of gun shown in FIGS. 1 to 3, both for the "bead-plane" and the "gun-plane." The cases treated are (1) without a suppressor, (2) with a suppressor ring and (3) with metalized bead according to the invention. The charge density required to support electron avalanches (blue glow) on neck glass as a function of position along the neck glass surface is shown in FIG. 6. FIG. 6 shows the required distribution on the neck glass surface of charge density $\rho$ (1-(k/1.58)) for maintenance of electron avalanches for the particular type of gun described above. If this charging cannot be maintained, avalanches can not exist. Since the glass is slightly conducting, charges will flow away from areas of large charge density. Thus for cases where large charge densities and gradients are required, avalanches are less likely to occur.

Consider the curve 73 for the bead plane with no suppressor present. Here $\rho$ is relatively low, and no steep gradients are called for; thus formation of avalanches is favorable. In contrast, the curve 75 for the gun plane with no suppressor present requires large values of $\rho$ and steep gradients; thus avalanches are unlikely, in agreement with experimental evidence.

Next consider the curve 77 for the bead plane with a wire suppressor ring present. Here very large $\rho$ values are reached in the vicinity of the suppressor ring, showing its effectiveness to prevent avalanches. One weakness of this structure is related to the region between the suppressor ring and $G_4$. Microprotrusions on the suppressor ring itself can lead to field emission and avalanches between the G4 and the suppressor ring where relatively low values of $\rho$ are required. This phenomenon is frequently observed and requires rigorous high-voltage processing of the suppressor ring itself.

Finally, in FIG. 6 is shown the curve 79 for the bead plane with a metalized bead employed in the novel CRT of FIGS. 1, 2 and 3. This curve 79 is similar to the curve 75 for the gun plane with no suppressor present. The metalized bead makes the bead-plane as unfavorable for avalanches as the case for the gun plane. In addition, an evaporated metallic film can be made with a very smooth feathered edge that is unfavorable for field emission.

In view of the foregoing considerations, each electrically-conducting area may be of any size and/or shape, and the same or different sizes and/or shapes may be used on different beads in the same tube. For greatest flashover suppression, the area should be as wide and as long as possible without providing sources of cold or hot emission. The term "electrically-conducting" means that it is preferred that each area has the resistivity of a metal, but higher resistivity areas which do not accumulate electrical charges on localized portions thereof when the tube is operated may be used. Generally, the area should have a resistivity of less than about 50,000 ohms per square. The areas are preferably not connected; that is, electrically floating, but may be connected to a fixed potential such as the $G_3$ electrode.

It is preferred that the electrically-conducting areas, particularly if they are metal coatings, are as free of points and protrusions as possible, in order to avoid providing efficient sources of field emission. The highest voltage is carried on the $G_4$ or second focusing electrode. The closer the edges of the electrically-conducting areas are to the $G_4$, the higher the electric fields present at those edges and the more chance there is of field emission. In view of this, it is preferred to taper the thickness of the areas toward their edges, particularly toward the edge towards $G_4$ so that the edge thereof is very smooth and thin. This makes it possible to extend the areas closer to the electrode carrying the highest voltage; the $G_4$ electrode in this case.

The electrically-conducting areas can be a surface treatment to the beads or can be a coating on the beads. It is preferred to make the areas a metallic coating such as of chromium metal, aluminum metal, silver metal, inconel alloy or platinum metal. Chromium, aluminum, silver and inconel can be deposited in vacuum from the vapor thereof. Also, the areas can be produced by a metalizing process, such as by painting or spraying a layer of a platinum resinate on the beads and then heating the beads to cure the layer. The conducting areas may be produced before or after the mount assembly is assembled, and before or after the mount assembly is sealed into the neck of the CRT, and before or after the envelope is exhausted and sealed.

In one embodiment, a masking fixture comprising metal tubing having two rectangular windows is positioned over the mount assembly with the windows at the location where the conducting areas are desired. There is a space of about one mm between the beads and the windows. The assembly is placed in a bell jar evaporator with a chromium-plated tungsten wire opposite each window. The jar is evacuated, and the wire is heated to about 1000° C. whereby chromium metal is vaporized from the wire and coatings of about 1000 Å thick are deposited on the beads. Because of the space between the beads and the windows, the coatings are feathered or tapered at all of the edges. In another embodiment, the same procedure is followed, but aluminum is substituted for chromium.

In still another embodiment, each bead is metalized; that is, receives its conducting area before the bead is incorporated into a mount assembly. In this embodiment, the bead is coated in the desired area with Hanovia Liquid Bright Platinum No. 5, which is a metal resinate marketed by Englehard Industries Inc., East Newark, N.J. A resinate coating may be produced by any of the known processes such as painting, screening, spraying, or by print transfer. The resinate-coated bead is then heated to about 500° C. in air to volatilize organic matter and to cure the coating and then cooled to room temperature. The metalized bead may then be used in any of the known beading processes for assembling a beaded mount assembly.

Figure 7:
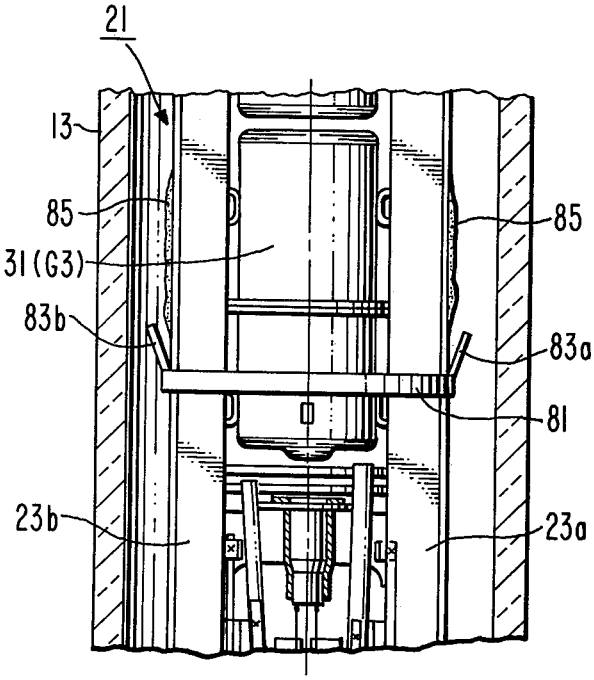
FIG. 7 is a fragmentary elevational view of the neck of a CRT illustrating an alternative method for practicing the invention.

In still another embodiment, the electrically-conducting coating is produced on the bead after the mount assembly has been sealed into the neck and the CRT is evacuated. FIG. 7 shows the neck 13 and mount assembly 21 shown in FIG. 1 modified in that a refractory metal strap or ribbon 81 is positioned completely around the mount assembly opposite the $G_3$. Integral with the strap 81 are tabs 83*a* and 83*b* towards $G_4$ positioned opposite the beads 23*a* and 23*b* respectively, each at an acute angle with the bead surfaces. The surface of the tab facing the bead was coated with an evaporable metal. After the CRT was exhausted, RF energy was coupled to the strap 81 whereby the strap 81 got hot, evaporating the metal coating thereon, which then deposited as the conducting area 85 on the opposite bead surface which was relatively cold. A chromium-plated tungsten strap or silver-plated stainless-steel strap can be used to deposit chromium or silver in this manner.

I claim:

1. A cathode-ray tube comprising an evacuated envelope including an electrically-insulating neck, and an electron-gun mount assembly in said neck, said mount assembly comprising a plurality of electrodes mounted on at least two electrically-insulating support rods, said assembly being closely spaced from the inner surface of said neck, at least a portion of the surface of each of said support rods facing a portion of said neck being electrically conducting each of said electrically conducting portions being opposite an electrode that participates in focusing said electron beam, and having a resistivity of less than about 50,000 ohms per square and is electrically floating.

2. The cathode-ray tube defined in claim 1 wherein each of said electrically-conducting portions consists essentially of a metal coating adhered to the surface of a support rod.

3. The cathode-ray tube defined in claim 2 including a metal strap around said mount assembly, said strap including a carrier surface at an acute angle to each of said support rod surfaces from which the metal for said coating was evaporated.

4. The cathode-ray tube defined in claim 1 wherein the thickness of each of said electrically-conducting portions is tapered toward at least one edge thereof in such manner as to minimize electron emission therefrom in the presence of an electric field.

5. A cathode-ray tube comprising (a) an evacuated envelope including a glass neck and (b) an electron-gun mount assembly in said neck, said mount assembly comprising (1) a plurality of electrodes related to provide for generating, forming and focusing at least one electron beam, (2) at least two elongated glass support beads peripheral to said electrodes and providing support and affixed positioning to said electrodes, each of said support beads having an extended surface closely spaced from and facing the inner surface of said neck (3) a conducting coating on a portion of each of said bead surfaces facing a portion of said neck surface that is opposite an electrode that participates in focusing an electron beam, each of said coatings having a resistivity of less than about 50,000 ohms per square and each of said coatings is electrically floating, and (c) means for applying operating voltages to said electrodes.

6. The cathode-ray tube defined in claim 5 wherein the thickness of said conducting coating is tapered to be thinnest along the edge thereof towards the region of highest electric field in such manner as to minimize field emission therefrom when said operating voltages are applied.

7. The cathode-ray tube defined in claim 5 wherein said conducting coating essentially of metallic chromium.

8. The cathode-ray tube defined in claim 5 wherein said conducting coating consists essentially of metallic aluminum.

9. The cathode-ray tube defined in claim 5 wherein said conducting coating consists essentially of metallic platinum.

* * * * *